US008036884B2

(12) United States Patent
Lam et al.

(10) Patent No.: US 8,036,884 B2
(45) Date of Patent: Oct. 11, 2011

(54) IDENTIFICATION OF THE PRESENCE OF SPEECH IN DIGITAL AUDIO DATA

(75) Inventors: Yin Hay Lam, Stuttgart (DE); Josep Maria Sola I Caros, Corcelles (CH)

(73) Assignee: Sony Deutschland GmbH, Cologne (DE)

( * ) Notice: Subject to any disclaimer, the term of this patent is extended or adjusted under 35 U.S.C. 154(b) by 1102 days.

(21) Appl. No.: 11/065,555

(22) Filed: Feb. 24, 2005

(65) Prior Publication Data

US 2005/0192795 A1 Sep. 1, 2005

(30) Foreign Application Priority Data

Feb. 26, 2004 (EP) ..... 04004416

(51) Int. Cl.
*G10L 19/14* (2006.01)

(52) U.S. Cl. ..... 704/205; 704/206; 704/208; 704/211; 704/214; 704/223; 704/222; 704/221; 704/219; 704/216; 704/227; 704/245; 704/256; 704/258; 704/266; 704/270; 704/500; 700/94; 84/609; 84/622

(58) Field of Classification Search ..... 704/21, 704/208, 245, 253, 221, 205, 206, 211, 214, 704/216, 219, 222, 223, 227, 258, 266, 270, 704/500; 84/609, 622; 700/94
See application file for complete search history.

(56) References Cited

U.S. PATENT DOCUMENTS 4,797,926 A * 1/1989 Bronson et al. ..... 704/214
5,008,941 A * 4/1991 Sejnoha ..... 704/222
5,574,823 A * 11/1996 Hassanein et al. ..... 704/208
5,664,052 A * 9/1997 Nishiguchi et al. ..... 704/214

(Continued)

OTHER PUBLICATIONS

M. Heldner: "Spectral Emphasis as an Additional Source of Information in Accent Detection" Prosody in Speech Recognition and Understanding, ISCA Prosody 2001, 'Online! Oct. 22, 2001-Oct. 24, 2001, XP002290439.

(Continued)

*Primary Examiner* — Vijay B. Chawan
*Assistant Examiner* — Michael Colucci
(74) *Attorney, Agent, or Firm* — Oblon, Spivak, McClelland, Maier & Neustadt, L.L.P.

(57) ABSTRACT

The present invention provides a method, a computer-software-product and an apparatus for enabling a determination of speech related audio data within a record of digital audio data. The method comprises steps for extracting audio features from the record of digital audio data, for classifying one or more subsections of the record of digital audio data, and for marking at least a part of the record of digital audio data classified as speech. The classification of the digital audio data record is performed on the basis of the extracted audio features and with respect to at least one predetermined audio class. The extraction of the at least one audio feature as used by a method according to the invention comprises steps for partitioning the record of digital audio data into adjoining frames, defining a window for each frame which is formed by a sequence of adjoining frames containing the frame under consideration, determining for the frame under consideration and at least one further frame of the window a spectral-emphasis-value which is related to the frequency distribution contained in the digital audio data of the respective frame, and assigning a presence-of-speech indicator value to the frame under consideration based on an evaluation of the differences between the spectral-emphasis-values determined for the frame under consideration and at least one further frame of the window.

17 Claims, 4 Drawing Sheets

U.S. PATENT DOCUMENTS

| | | | | |
|---|---|---|---|---|
| 5,680,508 | A * | 10/1997 | Liu | 704/227 |
| 5,712,953 | A * | 1/1998 | Langs | 704/214 |
| 5,761,642 | A * | 6/1998 | Suzuki et al. | 704/503 |
| 5,808,225 | A * | 9/1998 | Corwin et al. | 84/622 |
| 5,825,979 | A * | 10/1998 | Tsutsui et al. | 704/500 |
| 5,828,994 | A * | 10/1998 | Covell et al. | 704/211 |
| 5,933,803 | A * | 8/1999 | Ojala | 704/223 |
| 6,041,297 | A * | 3/2000 | Goldberg | 704/219 |
| 6,377,915 | B1 * | 4/2002 | Sasaki | 704/206 |
| 6,424,938 | B1 * | 7/2002 | Johansson et al. | 704/216 |
| 6,570,991 | B1 | 5/2003 | Scheirer et al. | |
| 6,678,654 | B2 * | 1/2004 | Zinser et al. | 704/221 |
| 6,678,655 | B2 * | 1/2004 | Hoory et al. | 704/223 |
| 6,836,761 | B1 * | 12/2004 | Kawashima et al. | 704/258 |
| 6,859,773 | B2 * | 2/2005 | Breton | 704/226 |
| 6,873,953 | B1 * | 3/2005 | Lennig | 704/253 |
| 7,363,218 | B2 * | 4/2008 | Jabri et al. | 704/221 |
| 2003/0101050 | A1 | 5/2003 | Khalil et al. | |
| 2003/0236663 | A1 * | 12/2003 | Dimitrova et al. | 704/245 |
| 2006/0080090 | A1 * | 4/2006 | Ramo et al. | 704/222 |
| 2007/0163425 | A1 * | 7/2007 | Tsui et al. | 84/609 |
| 2008/0201150 | A1 * | 8/2008 | Tamura et al. | 704/266 |
| 2009/0089063 | A1 * | 4/2009 | Meng et al. | 704/270 |
| 2009/0171485 | A1 * | 7/2009 | Sim et al. | 700/94 |
| 2010/0042408 | A1 * | 2/2010 | Malah et al. | 704/205 |
| 2010/0057476 | A1 * | 3/2010 | Sudo et al. | 704/500 |
| 2010/0198587 | A1 * | 8/2010 | Ramabadran et al. | 704/205 |

OTHER PUBLICATIONS

Han K-P et al: "Genre Classification System of TV Sound Signals Based on a Spectrogram Analysis" IEEE Transactions on Consumer Electronics, IEEE Inc. New York, US, vol. 44, No. 1, Feb. 1, 1998, pp. 33-42, XP000779248.

El-Maleh K et al: "Speech/Music Discrimination for Multimedia Applications" 2000 IEEE International Conference on Acoustics, Speech, and Signal Processing. Proceedings. (ICASSP). Istanbul, Turkey, Jun. 5-9, 2000, IEEE International Conference on Acoustics, Speech, and Signal Processing (ICASSP), New York, NY: IEEE, US, vol. 4 of 6, Jun. 5, 2000, pp. 2445-2448, XP000993729.

Joseph P. Campbell, Jr., "Speaker Recognition: A Tutorial", Proceedings of the IEEE, vol. 85, No. 9, Sep. 1997, pp. 1437-1462.

Lie Lu, et al., "Content Analysis for Audio Classification and Segmentation", IEEE Transactions on Speech and Audio Processing, vol. 10, No. 7, Oct. 2002, pp. 504-516.

Jitendra Ajmera, et al., "Robust HMM-Based Speech/Music Segmentation", ICASSP, 2002, 4 pages.

Lie Lu, et al., "A Robust Audio Classification and Segmentation Method", Proceedings of the Ninth ACM International Conference on Multimedia, 2001, 9 pages.

* cited by examiner

IDENTIFICATION OF THE PRESENCE OF SPEECH IN DIGITAL AUDIO DATA

The present invention relates to a structural analysis of a record of digital audio data for classifying the audio content of the digital audio data record according to different audio types. The present invention relates in particular to the identification of audio contents in the record that relate to the speech audio class.

BACKGROUND

A structural analysis of records of digital audio data like e.g. audio streams, digital audio data files or the like prepares the ground for many audio processing technologies like e.g. automatic speaker verification, speech-to-text systems, audio content analysis or speech recognition. Audio content analysis extracts information concerning the nature of the audio signal directly from the audio signal itself. The information is derived from an identification of the various origins of the audio data with respect to different audio classes, such as speech, music, environmental sound and silence. In many applications like e.g. speaker recognition, speech processing or application providing a preliminary step in identifying the corresponding audio classes, a gross classification is preferred that only distinguishes between audio data related to speech events and audio data related to non-speech events.

In automatic audio analysis spoken content typically alternates with other audio content in a not foreseeable manner. Furthermore, many environmental factors usually interfere with the speech signal making a reliable identification of the speech signal extremely difficult. Those environmental factors are typically ambient noise like environmental sounds or music, but also time delayed copies of the original speech signal produced by a reflective acoustic surface between the speech source and the recording instrument. For classifying audio data so-called audio features are extracted from the audio data itself, which are then compared to audio class models like e.g. a speech model or a music model by means of pattern matching. The assignment of a subsection of the record of digital audio data to one of the audio class models is typically performed based on the degree of similarity between the extracted audio features and the audio features of the model. Typical methods include Dynamic Time Warping (DTW), Hidden Markov Model (HMM), artificial neural networks, and Vector Quantisation (VQ).

The performance of a state of the art speech and sound classification system usually deteriorates significantly when the acoustic environment for the audio data to be examined deviates substantially from the training environment used for setting up the recording data base to train the classifier. But in fact, mismatches between a training and a current acoustic environment unfortunately happen again and again.

SUMMARY

It is therefore an object of the present invention to provide a reliable determination of speech related audio data within a record of digital audio data that is robust to acoustic environmental interferences.

This object is achieved by a method, a computer software product, and an audio data processing apparatus according to the independent claims.

Regarding the method proposed for enabling a determination of speech related audio data within a record of digital audio data, it comprises steps for extracting audio features from the record of digital audio data, classifying the record of digital audio data, and marking at least part of the record of digital audio data classified as speech. The classification of the digital audio data record is hereby performed based on the extracted audio features and with respect to one or more audio classes.

The extraction of the at least one audio feature as used by a method according to the invention comprises steps for partitioning the record of digital audio data into adjoining frames, defining a window for each frame with the window being formed by a sequence of adjoining frames containing the frame under consideration, determining for the frame under consideration and at least one further frame of the window a spectral-emphasis-value that is related to the frequency distribution contained in the digital audio data of the respective frame, and assigning a presence-of-speech indicator value to the frame under consideration based on an evaluation of the differences between the spectral-emphasis-values obtained for the frame under consideration and the at least one further frame of the window. The presence-of-speech indicator value hereby indicates the likelihood of a presence or absence of speech related audio data in the frame under consideration.

Further, the computer-software-product proposed for enabling a determination of speech related audio data within a record of digital audio data comprises a series of state elements corresponding to instructions which are adapted to be processed by a data processing means of an audio data processing apparatus such, that a method according to the invention may be executed thereon.

The audio data processing apparatus proposed for achieving the above object is adapted to determine speech related audio data within a record of digital audio data by comprising a data processing means for processing a record of digital audio data according to one or more sets of instructions of a software programme provided by a computer-software-product according to the present invention.

The present invention enables an environmental robust speech detection for real life application audio classification systems as it is based on the insight, that unlike audio data belonging to other audio classes, speech related audio data show very frequent transitions between voiced and unvoiced sequences in the audio data. The present invention advantageously uses this peculiarity of speech, since the main audio energy is located at different frequencies for voiced and unvoiced audio sequences.

Real-time speech identification such as e.g. speaker tracking in video analysis is required in many applications. A majority of these applications process audio data represented in the time domain, like for instance sampled audio data. The extraction of at least one audio feature is therefore preferably based on the record of digital audio data providing the digital audio data in a time domain representation.

Further, the evaluation of the differences between the spectral-emphasis-values determined for the frame under consideration and the at least one further frame of the window is preferably effected by determining the difference between the maximum spectral-emphasis-value determined and the minimum spectral-emphasis-value determined. Thus, a highly reliable determination of a transition between voiced and unvoiced sequences within the window is achieved. In an alternative embodiment, the evaluation of the differences between the spectral-emphasis-values determined for the frame under consideration and the at least one further frame of the window is effected by forming the standard deviation of the spectral-emphasis-values determined for the frame under consideration and the at least one further frame of the window. In this manner, multiple transitions between voiced and unvoiced audio sequences which might possibly present in an examined window are advantageously utilised for determining the presence-of-speech indicator value.

As the SpectralCentroid operator directly yields a frequency value which corresponds to the frequency position of the main audio energy in an examined frame, the spectral-emphasis-value of a frame is preferably determined by applying the SpectralCentroid operator to the digital audio data forming the frame. In a further embodiment of the present invention the spectral emphasis value of a frame is determined by applying the AverageLSPP operator to the digital audio data forming the frame, which advantageously makes the analysis of the energy content of the frequency distribution in a frame insensitive to influences of a frequency response of e.g. a microphone used for recording the audio data.

For judging the audio characteristic of a frame by considering the frames preceding it and following it in an equal manner, the window defined for a frame under consideration is preferably formed by a sequence of an odd number of adjoining frames with the frame under consideration being located in the middle of the sequence.

BRIEF DESCRIPTION OF THE DRAWINGS

In the following description, the present invention is explained in more detail with respect to special embodiments and in relation to the enclosed drawings, in which.

DETAILED DESCRIPTION

The present invention is based on the insight, that transitions between voiced and unvoiced sequences or passages, respectively, in audio data happen much more frequently in those audio data which are related to speech than in those which are related to other audio classes. The reason for this is the peculiar way in which speech is formed by an acoustic wave passing through the vocal tract of a human being. An introduction into speech production is given e.g. by Joseph P. Campbell in "Speaker Recognition: A Tutorial" Proceedings of the IEEE, Vol. 85, No. 9, September 1997, which further presents the methods applied in speaker recognition and is herewith incorporated by reference.

Speech is based on an acoustic wave arising from an air stream being modulated by the vocal folds and/or the vocal tract itself. So called voiced speech is the result of a phonation, which means a phonetic excitation based on a modulation of an airflow by the vocal folds. A pulsed air stream arising from the oscillating vocal folds is hereby produced which excites the vocal tract. The frequency of the oscillation is called a fundamental frequency and depends upon the length, tension and mass of the vocal folds. Thus, the presence of a fundamental frequency resembles a physically based, distinguishing characteristic for speech being produced by phonetic excitation.

Unvoiced speech results from other types of excitation like e.g. frication, whispered excitation, compression excitation or vibration excitation which produce a wide-band noise characteristic.

Speaking requires to change between the different types of modulation very frequently thereby changing between voiced and unvoiced sequences. The corresponding high frequency of transitions between voiced and unvoiced audio sequences cannot be observed in other sound classes such as e.g. music. An example is given in the following table indicating unvoiced and voiced audio sequences in the phrase 'catch the bus'. Each respective audio sequence corresponds to a phonem, which is defined as the smallest contrastive unit in a sound system of a language. In Table 1, 'v' stands for a voiced phonem and 'u' stands for an unvoiced.

TABLE 1

| voiced/unvoiced audio sequences in the phrase 'catch the bus' | | |
|---|---|---|
| Catch | the | bus |
| uvuuu | uvv | uvu |

Voiced audio sequences can be distinguished from unvoiced audio sequences by examining the distribution of the audio energy over the frequency spectrum present in the respective audio sequences. For voiced audio sequences the main audio energy is found in the lower audio frequency range and for unvoiced audio sequences in the higher audio frequency range.

Figure 1A:
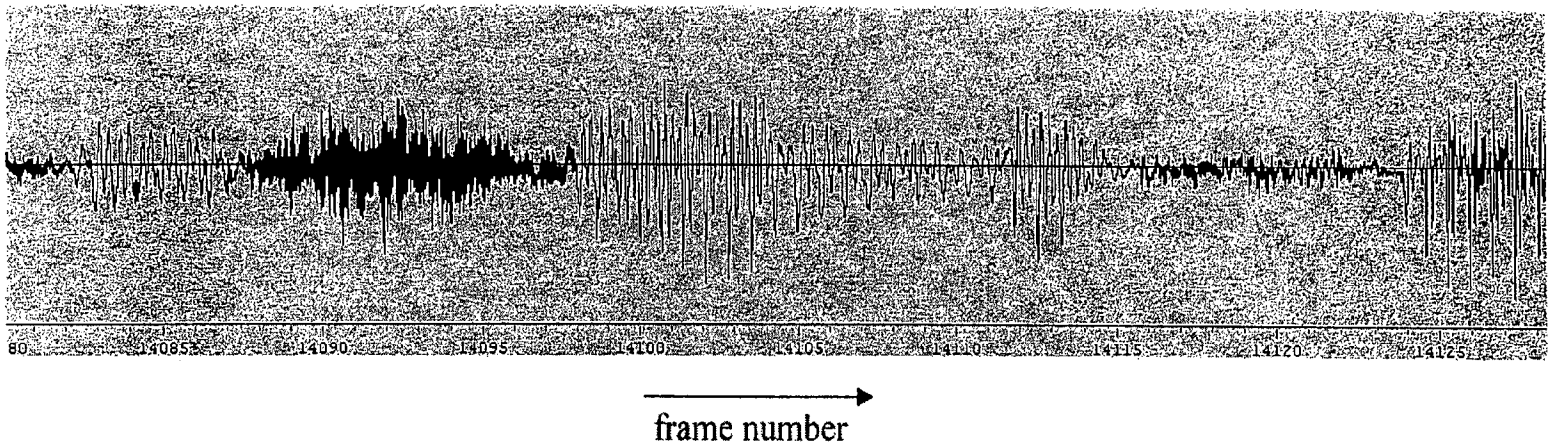
FIG. 1*a* shows a sequence from a digital audio data record represented in the time domain, whereby the record corresponds to about half a second of speech recorded from a German TV programme presenting a male speaker.

FIG. 1*a* shows a partial sequence of sampled audio data which were obtained from a male speaker when recorded in a German TV programme. The audio data are represented in the time domain, i.e. showing the amplitude of the audio signal versus the time scaled in frame units. As the main audio energy of voiced speech is found in the lower energy range, a corresponding audio sequence can be distinguished from unvoiced audio sequences in the time domain by its lower number of zero crossings.

Figure 1B:
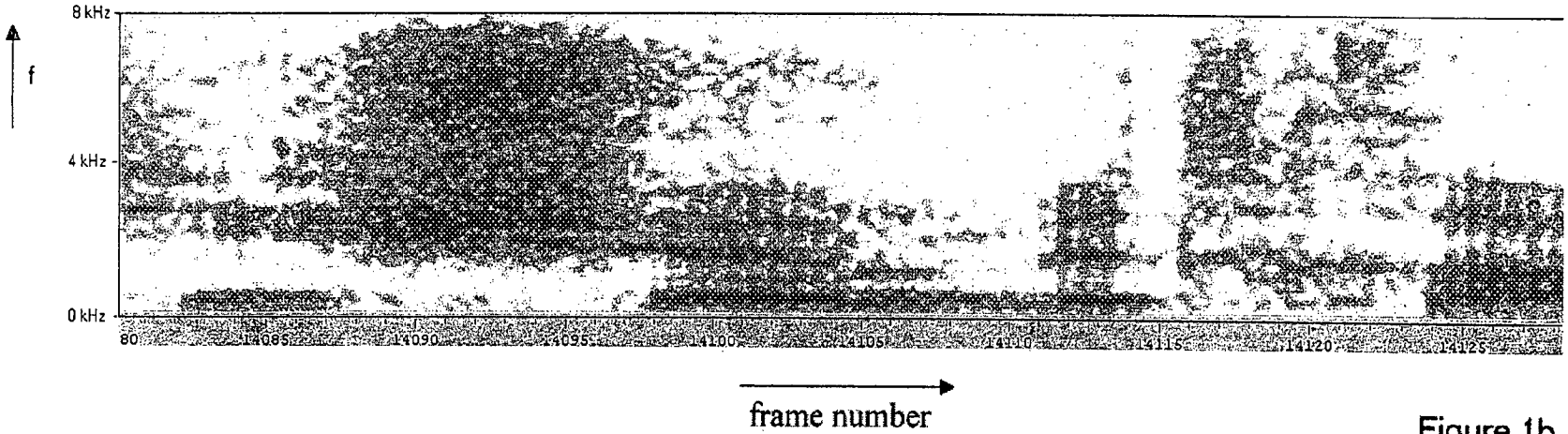
FIG. 1*b* shows the sequence of audio data of FIG. 1*a* but represented in the frequency domain.

A more reliable classification is made possible from the representation of the audio data in the frequency domain as shown in FIG. 1*b*. The ordinate represents the frequency co-ordinate and the abscissa the time co-ordinate scale in frame units. Each sample is indicated by a dot in the thus defined frequency-time space. The darker a dot, the more audio energy is contained in the spectral value represented by that dot. The frequency range shown extendes from 0 to about 8 kHz.

The major part of the audio energy contained in the unvoiced audio sequence ranging from about frame no. 14087 to about frame no. 14098 is more or less evenly distributed over the frequency range between 1.5 kHz and the maximum frequency of 8 kHz. The next following audio sequence, which ranges from about frame no. 14098 to about frame no. 14105 shows the main audio energy concentrated at a fundamental frequency below 500 Hz and some higher harmonics in the lower kHz range. Practically no audio energy is found in the range above 4 kHz.

Figure 2A:
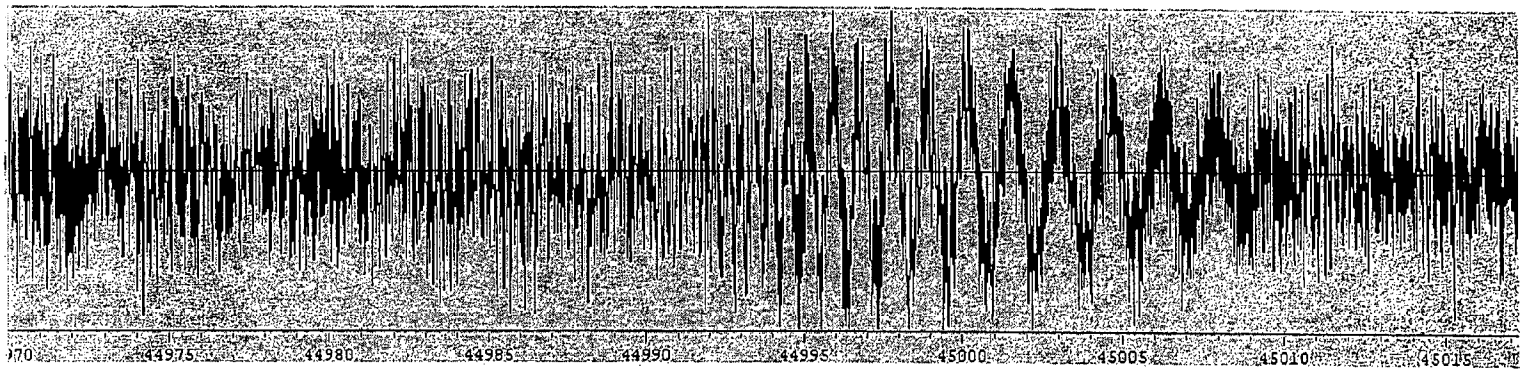
FIG. 2*a* shows a time domain representation of about a half second long sequence of audio data of a record of digital audio data representing music recorded in a German TV programme.
Figure 2B:
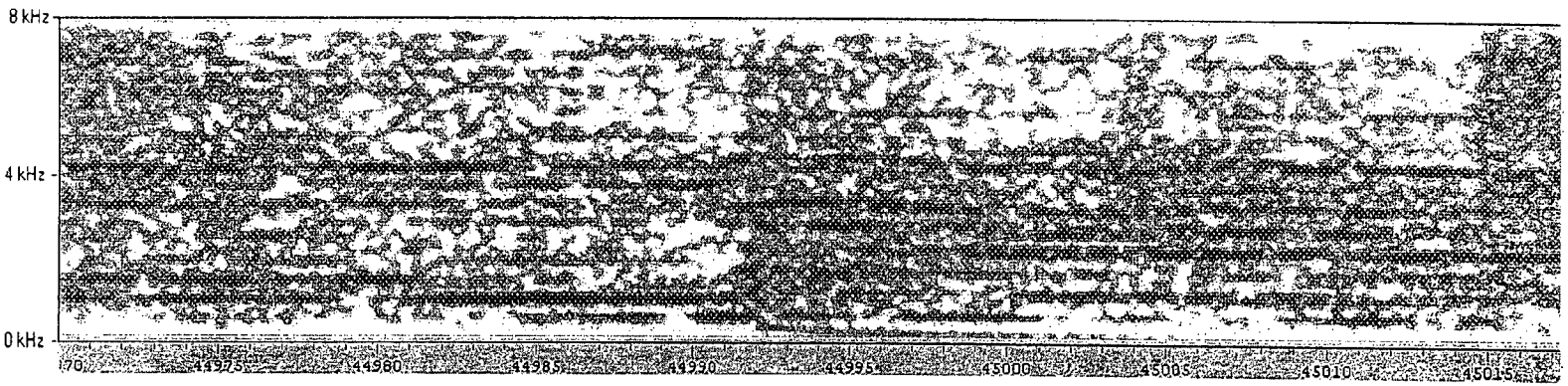
FIG. 2*b* shows the audio sequence of FIG. 2*a* in the frequency domain.

The music data shown in the time domain representation of FIG. 2*a* and in the frequency domain in FIG. 2*b* show a completely different behaviour. The audio energy is distributed over nearly the complete frequency range with a few particular frequencies emphasised from time to time.

While the speech data of FIG. 1 show clearly recognisable transitions between unvoiced and voiced sequences, a likewise behaviour can not be observed for the music data of FIG. 2. Audio data belonging to other audio classes like environmental sound and silence show the same behaviour as music. This fact is used to derive an audio feature for indicating the presence of speech from the audio data itself. The audio feature is meant to indicate the likelihood of the presence or absence of speech data in an examined part of a record of audio data.

A determination of speech data in a record of digital audio data is preferably performed in the time domain, as the audio data are in most applications available as sampled audio data. The part of the record of digital audio data which is going to be examined is first partitioned into a sequence of adjoining frames, whereby each frame is formed by a subsection of the record digital audio data defining an interval within the record of digital audio data. The interval typically corresponds to a time period between ten to thirty milliseconds.

Unlike the customary feature extraction techniques, the present invention does not restrict the evaluation of an audio feature indicating the presence of speech data in a frame to the frame under consideration itself. The respective frame under consideration will be referred to in the following as working frame. Instead, the evaluation makes also use of frames neighbouring the working frame. This is achieved by defining a window formed by the working frame and some preceding and following frames such that a sequence of adjoining frames is obtained.

Figure 3:
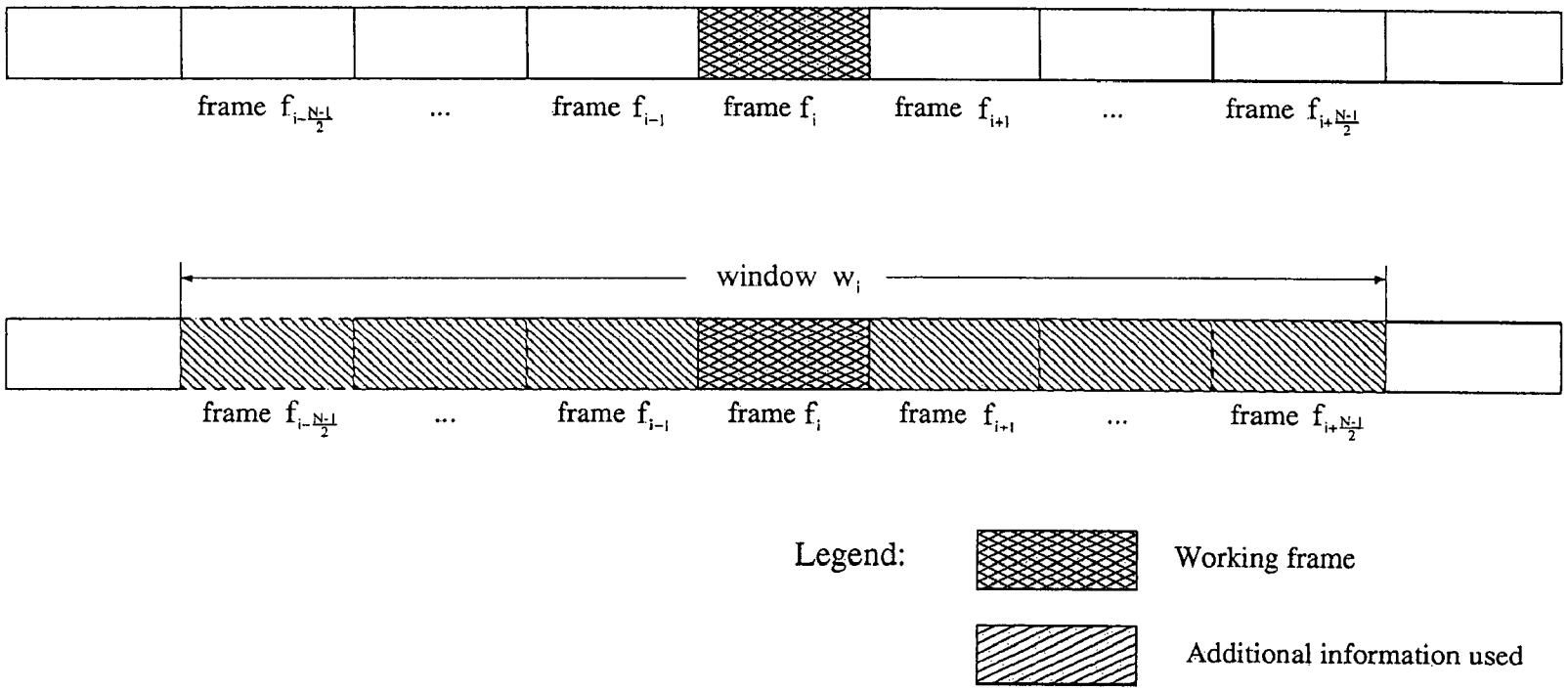
FIG. 3 shows the difference between a standard frame-based-feature extraction and a window-based-frame-feature extraction according to the present invention.

This is illustrated in FIG. 3, showing the conventional single frame based audio feature extraction technique in the upper, and the window based frame audio feature extraction technique according to the present invention in the lower representation. While the conventional technique uses only information from the working frame $f_i$ to extract an audio feature, the present invention uses information from the working frame and additional information from neighbouring frames.

To achieve an equal contribution of the frames preceding the working frame and the frames following the working frame, the window is preferably formed by an odd number of frames with the working frame located in the middle. Given the total number of frames in the window as N and placing the working frame $f_i$ in the centre, the window $w_i$ for the working frame $f_i$ will start with frame $f_{i-(N-1)/2}$ and end with frame $f_{i+(N-1)/2}$.

For evaluating the audio feature for frame $f_i$, first a so called spectral-emphasis-value is determined for each frame $f_j$ within the window $w_i$, i.e. $j \in [i-(N-1)/2, i+(N-1)/2]$. The spectral-emphasis-value represents the frequency position of the main audio energy contained in a frame $f_j$. Next, the differences between the spectral-emphasis-values obtained for each of the various frames $f_j$ within the window $w_i$ are rated, and a presence-off-speech indicator value is determined based on the rating, and assigned to the working frame $f_i$.

The higher the differences in spectral-emphasis-values determined for the various frame $f_j$, the higher is the likelihood of speech data being present in the window $w_i$ defined for the working frame $f_i$. Since a window comprises more than one phonem, a transition from voiced to unvoiced or from unvoiced to voiced audio sequences can easily be identified by the windowing technique described. If the variation of the spectral-emphasis-values obtained for a window $w_i$ exceeds what is expected for a window containing only frames with voiced or only frames with unvoiced audio data, a certain likelihood for the presence of speech data in the window is given. This likelihood is represented in the value of the presence-of-speech indicator.

In a preferred embodiment of the present invention, the presence-of-speech indicator value is obtained by applying a voiced/unvoiced transition detection function $vud(f_i)$ to each window $w_i$ defined for a working frame $f_i$, which basically combines two operators, namely an operator for determining the frequency position of the main audio energy in each frame $f_j$ of the window $w_i$ and a further operator rating the obtained values according to their variation in the window $w_i$.

In a first embodiment of the present invention, the voiced/unvoiced transition detection function $vud(f_i)$ is defined as $$vud(f_i) = \text{range}_{j=i-\frac{N-1}{2}\ldots i+\frac{N-1}{2}} \cdot SpectralCentroid(f_j) \text{ wherein} \quad (1)$$

$$SpectralCentroid(f_j) = \frac{\sum_{k=1}^{N_{coeff}} k \cdot FFT_j(k)}{\sum_{k=1}^{N_{coeff}} FFT_j(k)} \quad (2)$$

with $N_{coeff}$ being the number of coefficients used in the Fast Fourier Transform analysis $FFT_j$ of the audio data in the frame $f_j$ of the window.

The operator '$range_j$' simply returns the difference between the maximum value and the minimum value found for SpectralCentroid ($f_j$) in the window $w_i$ defined for the working frame $f_i$.

The function SpectralCentroid ($f_j$) determines the frequency position of the main audio energy of a frame $f_j$ by weighting each spectral line found in the audio data of the frame $f_j$ according to the audio energy contained in it.

The frequency distribution of audio data is principally defined by the source of the audio data. But the recording environment and the equipment used for recording the audio data also frequently have a significant influence on the spectral audio energy distribution finally obtained. To minimise the influence of the environment and the recording equipment, the voiced/unvoiced transition detection function vud ($f_i$) is in a second embodiment of the present invention therefore defined by:

$$vud(f_i) = \text{range}_{j=i-\frac{N-1}{2}\ldots i+\frac{N-1}{2}} \cdot AverageLSPP(f_j) \text{ wherein} \quad (3)$$

$$AverageLSPP(f_j) = \frac{1}{OrderLPC/2} \cdot \sum_{k=1}^{OrderLPC/2} MLSF_j(k) \quad (4)$$

with $MLSF_j(k)$ being defined as the position of the Linear Spectral Pair k computed in frame $f_j$, and with OrderLPC indicating the number of Linear Spectral Pairs (LSP) obtained for the frame $f_j$. A Linear Spectral Pair (LSP) is just one alternative representation of the Linear Prediction Coefficients (LPCs) presented in the above cited article by Joseph P. Campbell.

The frequency information of the audio data in frame $f_j$ is contained in the LSPs only implicitly. Since the position of a Linear Spectral Pair k is the average of the two corresponding Linear Spectral Frequencies (LSFs), a corresponding transformation results the required frequency information. The peaks in the frequency envelope obtained correspond to the LSPs and indicate the frequency positions of prominent audio energies in the examined frame $f_j$. By forming the average of the frequency positions of the thus detected prevailing audio energies as indicated in equation (4), the frequency position of the main audio energy in a frame is obtained.

As described, Linear Spectral Frequencies (LSFs) tend to be where the prevailing spectral energies are present. If prominent audio energies of a frame are located rather in the lower frequency range as is to be expected for audio data containing voiced speech, the operator AverageLSPP ($f_j$) returns a low frequency value even if the useful audio signal is interfered with by environmental background sound or recording influences.

Although the range operator is used in the proposed embodiments defined by equations (1) and (3), any other operator which takes similar information, like e.g. the standard deviation operator can be used. The standard deviation operator determines the standard deviation of the values obtained for the frequency position of the main energy content for the various frames $f_j$ in a window $w_i$.

Both, Spectral Centroid Range (vud($f_i$) according to equation (1)) and Average Linear Spectral Pair Position Range (vud($f_i$) according to equation (3)) can be utilised as audio features in an audio classification system adapted to distinguish between speech and sound contributions to a record of digital audio data. Both features may be used alone or in addition to other common audio features such as for example MFCC (Mel Frequency Cepstrum Coefficients). Accordingly, a hybrid audio feature set may be defined by $$\text{HybridFeatureSet}_{fi}=[vud(f_i),MFCC'_{fi}] \quad (5)$$

wherein $MFCC'_{fi}$ represents the Mel Frequency Cepstrum Coefficients without the $C_0$ coefficient. Other audio features, like e.g. those developed by Lie Lu, Hong-Jiang Zhang, and Hao Jiang and published in the article "Content Analysis for Audio Classification and Segmentation", IEEE Transactions on Speech and Audio Processing, Vol. 10, NO. 7, October 2002, may of course be used in addition.

Figure 4:
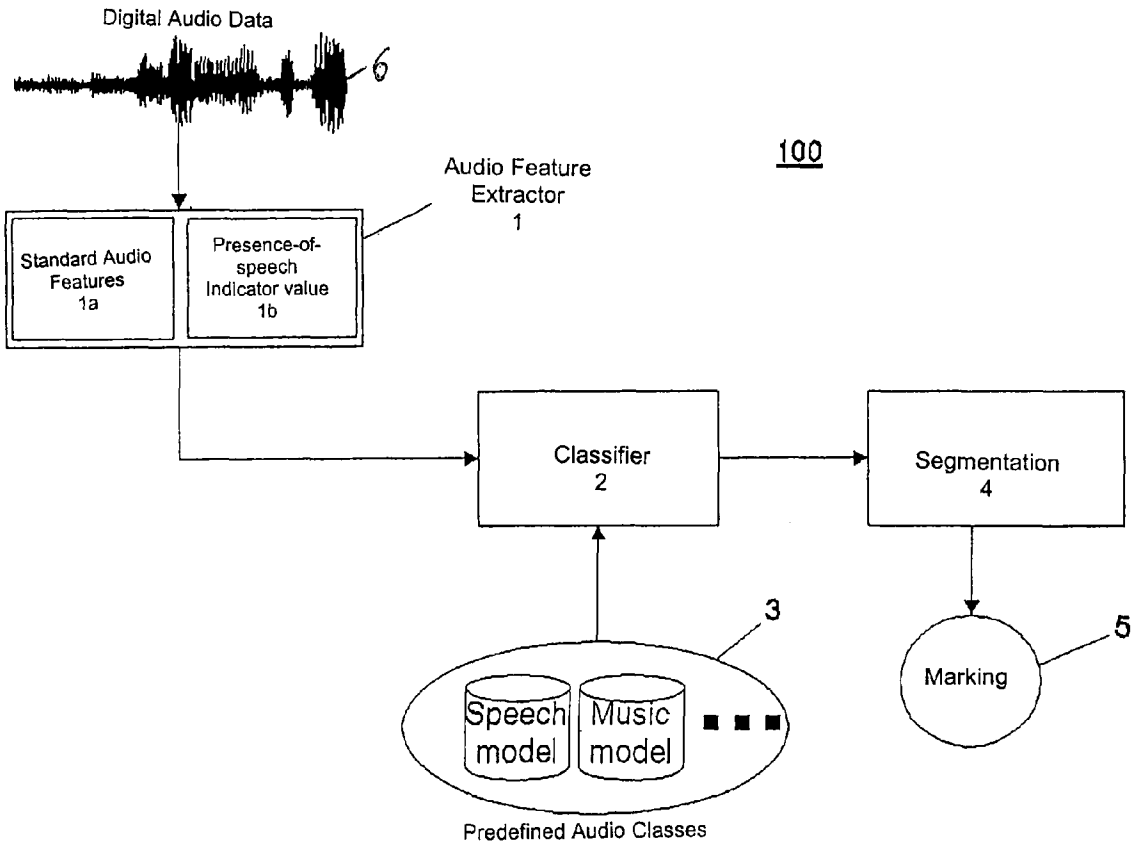
FIG. 4 is a block diagram showing an audio classification system according to the present invention.

FIG. 4 shows a system for classifying individual subsections of a record of digital audio data 6 in correspondence to predefined audio classes 3, particularly with respect to the speech audio class. The system 100 comprises an audio feature extracting means 1 which derives the standard audio features 1*a* and the presence-of-speech indicator value vud 1*b* according to the present invention from the original record of digital audio data 6. The further main components of the audio data classification system 100 are the classifying means 2 which uses predetermined audio class models 3 for classifying the record of digital audio data, the segmentation means 4, which at least logically subdivides the record of digital audio data into segments such, that the audio data in a segment belong to exact the same audio class, and the marking means 5 for marking the segments according to their respective audio class assignment.

The process for extracting an audio feature according to the present invention, i.e. the voiced/unvoiced transition detection function vud($f_i$) from the record of digital audio data 6 is carried out in the audio feature extracting means 1. This audio feature extraction is based on the window technique as explained with respect to FIG. 3 above.

In the classifying means 2, the digital audio data record 6 is examined for subsections which show the characteristics of one of the predefined audio classes 3, whereby the determination of speech containing audio data is based on the use of the presence-of-speech indicator values as obtained from one or both embodiments of the voiced/unvoiced transition detection function vud($f_i$) or even by additionally using further speech related audio features as e.g. defined in equation (5). By thus merging a standard audio feature extraction with the vud determination, an audio classification system is achieved that is more robust to environmental interferences.

The audio classification system 100 shown in FIG. 4 is advantageously implemented by means of software executed on an apparatus with a data processing means. The software may be embodied as a computer-software-product which comprises a series of state elements adapted to be read by the processing means of a respective computing apparatus for obtaining processing instructions that enable the apparatus to carry out a method as described above. The means of the audio classification system 100 explained with respect to FIG. 4 are formed in the process of executing the software on the computing apparatus.

The invention claimed is:

1. A method for causing an audio data processing apparatus to determine speech related audio data within a recording of digital audio data based on transitions between voiced and unvoiced sequences, the method comprising:

extracting, in the audio data processing apparatus, audio features from the recording of digital audio data at an analyzing apparatus;

classifying, in the audio data processing apparatus, the recording of digital audio data based on the extracted audio features and with respect to one or more predetermined audio classes stored in an electronic memory of the apparatus;

marking, in the audio data processing apparatus, at least a part of the recording of digital audio data classified as speech, wherein the extraction of at least one audio feature includes partitioning the recording of digital audio data into adjoining frames;

defining, in the audio data processing apparatus and for each frame, a window being formed by a sequence of adjoining frames containing a frame under consideration;

determining, in the audio data processing apparatus, for the frame under consideration, and at least one next frame of the window, a spectral-emphasis-value which is related to a frequency distribution contained in the digital audio data of a respective frame and which represents a frequency at which a main audio energy is contained in the respective frame, the main audio energy indicating a major part of the audio energy in the respective frame, and classifying the frame under consideration as containing voiced or unvoiced audio data based on the spectral-emphasis-value of the frame under consideration; and assigning, in the audio data processing apparatus, a presence-of-speech indicator value to the frame under consideration based on an evaluation of the differences between the spectral-emphasis-values determined for the frame under consideration and the at least one next frame of the window, said presence-of-speech indicator value being based on a detection of transitions between frames containing voiced and unvoiced audio data.

2. The method according to claim 1, wherein the extraction of the at least one audio feature is based on the recording of digital audio data providing the digital audio data in a time domain representation.

3. The method according to claim 1, wherein the evaluation of the differences between the spectral-emphasis-values determined for the frame under consideration and the at least one next frame of the window is effected by determining the difference between the maximum spectral-emphasis-value and the minimum spectral-emphasis-value determined.

4. The method according to claim 1, wherein the evaluation of the differences between the spectral-emphasis-values determined for the frame under consideration and the at least one next frame of the window is effected by forming the standard deviation of the spectral-emphasis-values determined for the frame under consideration and the at least one next frame of the window.

5. The method according to claim 1, wherein the spectral-emphasis-value of a frame is determined by applying the SpectralCentroid operator to the digital audio data forming the frame.

6. The method according to claim 1, wherein the spectral-emphasis-value of a frame is determined by applying the AverageLSPP operator to the digital audio data forming the frame.

7. The method according to claim 1, wherein the window defined for a frame under consideration is formed by a sequence of an odd number of adjoining frames with the frame under consideration being located in the middle of the sequence.

8. The method according to claim 1, wherein a frame is formed by a subsection of the record digital audio data defining an interval, the interval corresponding to a time period between 10 ms to 30 ms.

9. The method according to claim 1, wherein a spectral-emphasis-value is equally determined, in the audio data processing apparatus, for the frame under consideration and at least one preceding and at least one following frame.

10. The method according to claim 5, wherein the SpectralCentroid operator is defined as $$SpectralCentroid(f_j) = \frac{\sum_{k=1}^{N_{coeff}} k \cdot FFT_j(k)}{\sum_{k=1}^{N_{coeff}} FFT_j(k)}$$

with $N_{coeff}$ being a number of coefficients used in a Fast Fourier Transform analysis $FFT_j$ of the audio data in a frame $f_j$.

11. The method according to claim 10, wherein detection of transitions between voiced and unvoiced sequences is based on a voiced/unvoiced transition detection function, which is defined by $$vud(f_i) = range_{j=i-\frac{N-1}{2} \ldots i+\frac{N-1}{2}} \cdot SpectralCentroid(f_j),$$

the range operator indicates differences between spectral-emphasis-values.

12. The method according to claim 11, wherein the spectral-emphasis-value of a frame is determined by applying the SpectralCentroid operator in addition to another audio feature to define a hybrid audio feature set $$\text{HybridFeatureSet}_{f_i} = [vud(f_i), MFCC'_{f_i}],$$

where $vud(f_j)$ is a voiced/unvoiced transition detection function.

13. The method according to claim 6, wherein the AverageLSPP operator is defined as $$AverageLSSP(f_j) = \frac{1}{OrderLPC/2} \cdot \sum_{k=1}^{OrderLPC/2} MLSF_j(k)$$

with $MLSF_j(k)$ being defined as a position of a Linear Spectral Pair k computed in frame $f_j$, and with OrderLPC indicating a number of Linear Spectral Pairs (LSP) obtained for the frame $f_j$.

14. The method according to claim 13, wherein detection of transitions between voiced and unvoiced sequences is based on a voiced/unvoiced transition detection function, which is defined by $$vud(f_i) = range_{j=i-\frac{N-1}{2} \ldots i+\frac{N-1}{2}} \cdot AverageLSPP(f_j),$$

wherein the range operator indicates differences between spectral-emphasis-values.

15. The method according to claim 14, wherein the spectral-emphasis-value of a frame is determined by applying the AverageLSPP operator in addition to another audio feature to define a hybrid audio feature set $$\text{HybridFeatureSet}_{f_i} = [vud(f_i), MFCC'_{f_i}],$$

where $vud(f_j)$ is a voiced/unvoiced transition detection function.

16. A non-transitory computer-readable medium having computer-readable instructions thereon, the instructions when executed by a computer cause the computer to perform a method for determining speech related audio data within a recording of digital audio data based on transitions between voiced and unvoiced sequences, comprising:

extracting audio features from the recording of digital audio data at an analyzing apparatus;

classifying the recording of digital audio data based on the extracted audio features and with respect to one or more predetermined audio classes stored in an electronic memory of the apparatus;

marking at least a part of the recording of digital audio data classified as speech, wherein the extraction of at least one audio feature includes partitioning the recording of digital audio data into adjoining frames;

defining, for each frame, a window formed by a sequence of an odd number of adjoining frames with the frame under consideration located in the middle of the sequence;

determining for the frame under consideration and at least one next frame of the window a spectral-emphasis-value which is related to a frequency distribution contained in the digital audio data of a respective frame and which represents a frequency at which a main audio energy is contained in the respective frame, the main audio energy indicating a major part of the audio energy in the respective frame, and classifying the frame under consideration as containing voiced or unvoiced audio data based on the spectral-emphasis-value of the frame under consideration; and assigning a presence-of-speech indicator value to the frame under consideration based on an evaluation of the differences between the spectral-emphasis-values determined for the frame under consideration and the at least one next frame of the window, said presence-of-speech indicator value being based on a detection of transitions between frames containing voiced and unvoiced audio data.

17. An audio data processing apparatus for determining speech related audio data within a recording of digital audio data based on transitions between voiced and unvoiced sequences, comprising:

an extraction unit configured to extract audio features from a recording of digital audio data, including a defining unit configured to define, for each frame, a window formed by a sequence of an odd number of adjoining frames with the frame under consideration located in the middle of the sequence, a determining unit configured to determine for the frame under consideration and at least one next frame of the window a spectral-emphasis-value which is related to a frequency distribution contained in the digital audio data of a respective frame and which represents a frequency at which a main audio energy is contained in the respective frame, the main audio energy indicating a major part of the audio energy in the respective frame, and classifying the frame under consideration as containing voiced or unvoiced audio data based on the spectral-emphasis-value of the frame under consideration, and an assigning unit configured to assign a presence-of-speech indicator value to the frame under consideration based on an evaluation of the differences between the spectral-emphasis-values determined for the frame under consideration and the at least one next frame of the window, said presence-of-speech indicator value being based on a detection of transitions between frames containing voiced and unvoiced audio data;

a classification unit configured to classify the recording of digital audio data based on the extracted audio features and with respect to one or more predetermined audio classes stored in an electronic memory of the classification unit; and a marking unit configured to mark at least a part of the recording of digital audio data classified as speech, wherein the extraction of at least one audio feature includes partitioning the recording of digital audio data into adjoining frames.

* * * * *